US008857817B2

(12) United States Patent
Cruz-Rivera et al.

(10) Patent No.: US 8,857,817 B2
(45) Date of Patent: Oct. 14, 2014

(54) BOARD GAME AND METHOD OF PLAY

(71) Applicants: Edwin Arsenio Cruz-Rivera, Chandler, AZ (US); Janet Adriana Cruz, Chandler, AZ (US)

(72) Inventors: Edwin Arsenio Cruz-Rivera, Chandler, AZ (US); Janet Adriana Cruz, Chandler, AZ (US)

( * ) Notice: Subject to any disclaimer, the term of this patent is extended or adjusted under 35 U.S.C. 154(b) by 0 days.

(21) Appl. No.: 13/902,799

(22) Filed: May 25, 2013

(65) Prior Publication Data

US 2013/0320623 A1 Dec. 5, 2013

Related U.S. Application Data

(60) Provisional application No. 61/653,051, filed on May 30, 2012.

(51) Int. Cl.
*A63F 3/00* (2006.01)

(52) U.S. Cl.
USPC ..... 273/287; 273/261

(58) Field of Classification Search
USPC ..... 273/261, 287
See application file for complete search history.

(56) References Cited

U.S. PATENT DOCUMENTS

| | | | | | |
|---|---|---|---|---|---|
| 1,940,880 | A | * | 12/1933 | Pitter | 192/41 S |
| 2,138,764 | A | * | 11/1938 | Hipwell | 273/397 |
| 2,520,460 | A | * | 8/1950 | Ford | 124/7 |
| 3,787,053 | A | | 1/1974 | Breslow | |
| 3,860,242 | A | * | 1/1975 | Martin | 273/243 |
| 4,066,263 | A | * | 1/1978 | Balas et al. | 273/273 |
| 4,280,704 | A | * | 7/1981 | Massimei et al. | 273/258 |
| 4,357,017 | A | | 11/1982 | Schneider et al. | |
| 5,201,524 | A | * | 4/1993 | Csanady et al. | 273/248 |
| 5,752,703 | A | | 5/1998 | Wong | |
| 7,673,881 | B2 | | 3/2010 | Held et al. | |
| 2012/0061918 | A1 | | 3/2012 | Van Ness | |

* cited by examiner

*Primary Examiner* — Vishu K. Mendiratta
(74) *Attorney, Agent, or Firm* — Keith L. Jenkins, Registered Patent Attorney, LLC; Kieth L. Jenkins

(57) ABSTRACT

A game board surrounded and partially supported by perimeter walls that extend above and below the playing surface of the game board. The game board has a plurality of sockets for holding either covers, projectile coins, or player tokens, and a smaller plurality of those sockets have holes through the game board. Supporting the game board from underneath is a deflection structure that deflects projected tokens which fall though the holes and urges them out through elongated openings at the bottom of each wall. Projectors, such as catapults, are mounted slidingly on each perimeter wall. Players have covers with which they can cover a portion of the holes on their "properties. The board has designated paths for player token movement according to turn and a die role. An elevated socket is provided. The rules for an exemplary game to be played with the game board are explained.

20 Claims, 8 Drawing Sheets

BOARD GAME AND METHOD OF PLAY

RELATED APPLICATIONS

This application claims the benefit of U.S. provisional patent application Ser. No. 61/653,051 filed May 30, 2012 by the same inventors.

TECHNICAL FIELD

This invention relates to board games. More particularly, it relates to providing a board game that mixes strategy and luck management with physical skill.

BACKGROUND

Board games are popular and often rely on intellectual skill and luck management. Less common is a board game that also requires physical skill.

Therefore, a need exists for a board game that combines, intellectual skill, luck management, and physical skill.

OBJECTS AND FEATURES OF THE INVENTION

A primary object and feature of the present invention is to overcome the above-mentioned problems and fulfill the above-mentioned needs.

Another object and feature of the present invention is to provide a board game in which scoring is accomplished with a projectile.

It is a further object and feature of the present invention to provide a novel game board having a plurality of player "properties" each having a plurality of holes and covers for holes, where the covers are placed and removed strategically.

It is a further object and feature of the present invention to provide board game in which scoring is achieved by catapulting, or otherwise projecting, a projectile onto an opponent's cover and without the projectile going into one of the opponent's holes.

It is a further object and feature of the present invention to provide an alternate jackpot scoring means.

It is an additional primary object and feature of the present invention to provide such a system that is amusing, inexpensive and portable. Other objects and features of this invention will become apparent with reference to the following descriptions.

SUMMARY OF THE INVENTION

In accordance with a preferred embodiment hereof, this invention provides a board game that requires strategy, luck management, and physical skill. The game is for two to eight players, preferably aged eight years old or older. A square game board is provided comprising forty-nine square sockets oriented forty-five angular degrees to the sides of the game board. The twenty-eight perimeter square sockets provide a primary track for clockwise movement of player pieces around the game board, where movement is determined by a die roll. Two secondary, "Jackpot Lane" tracks are provided transverse to the sides of the game board and crossing in the middle of the game board. An elevated square on a pedestal is in the center of the game board. Entry to Jackpot Lane is via landing on the middle square of the perimeter track on any side of the perimeter track. The playing surface of the game board has ridges around each square, making the square into shallow square sockets.

The game board is elevated and surrounded by a four-walled enclosure abutting the four sides of the square game board. A catapult, or other projectile-hurling device, is slidingly mounted on each wall for hurling projectile coins, or tokens, onto the game board surface.

Jackpot Lanes divide the board into fourths, and each fourth is divided by a corner-to-corner diagonal ridge into two player properties of twelve square sockets each, of which three are perimeter track square sockets. Accordingly, there are eight player properties, or playing positions, on the game board. The right-most square of the three property perimeter track square sockets is designated as a starting point for a playing piece of that property's player. The other nine square sockets of the player property have holes in them, and each player has nine covers for covering those holes. The covers fit within the shallow socket defined by the ridges. Four of the nine covers are designated with multipliers, being X5, X4, X3, and X2 and five of the nine covers have no multipliers. All square sockets of a particular property are colored or shaded the same and each property is preferably colored or shaded differently from every other property on the game board. In addition to nine covers and a playing piece, each player receives a plurality of projectile coins, denominated $20, $10, $5, and $1. Each player receives three $20, three $10, five $5, and five $1 projectile coins before the game starts. The projectile coins are sized smaller than the holes in the board so that the projectile coins can fall through the holes in the game board if projected onto a square with an uncovered hole.

In setting up to begin the game, each player covers seven of the nine holes on his property using the four multiplier covers and three of the blank covers. The player may arrange the covers on his property in any pattern he desires. Strategically, it is preferred to place the high multiplier covers near the open holes, to increase the risk to a player who is trying to project a projectile coin onto a high multiplier cover.

For some numbers of players, each player may have more than one property. For example, in a four-player game, each player may have two properties. For further example, in a three-player game, each player may have two properties with the remaining two properties considered "frozen" properties. Landing on a perimeter track square of a frozen property is treated as a free space, with no consequences. If a projected coin lands on a frozen property, it is placed in Jackpot Lane. Frozen properties have all nine holes covered.

To play, a die is cast to determine who starts, and that player again casts a single die, preferably a six-sided die. The player moves his playing piece from his property's starting square a number of spaces equal to the number indicated on the rolled die. Depending on the square landed upon, different consequences result.

If a player lands on a frozen property square, there are no consequences and the next player takes his turn.

If a player lands on an opponent's perimeter track square that is one of the two perimeter track square sockets that are not a starting square, then the player gets to launch a projectile coin at that opponent's property in an attempt to get more projectile coins. The projecting player uses the catapult on the side of the board adjacent to his own property. Different results are determined based on where the projectile coin lands. If the coin lands on a multiplier covered square on the opponent's property, the opponent must pay the player an amount equal to the value of the coin projected times the multiplier on the cover. If the coin lands on a blank square, or misses the opponent's property entirely, or lands on a frozen property, the coin is placed on the nearest Jackpot Lane square to the square upon which the coin landed, and the player gets nothing. If the coin goes through a hole on the opponent's property, the opponent keeps the coin. If the projectile falls through a hole, it slides down an inclined plane and out of an opening in the wall below the level of the board. There are four triangular inclined planes below the board forming a pyramid, for sliding fall-through coins through each of the four walls.

If the player lands on an opponent's starting square, the player may either cover one of the opponent's holes or remove one of the blank covers on the player's own property, at the player's option.

If the player lands on one of the four Jackpot Lane square sockets on the perimeter track, the player first gets to shoot for the jackpot. If the player can project a $10 coin into the Jackpot square on the pedestal in the middle of the board, that player wins all the coins in all square sockets in Jackpot Lane. If the player does not have a $10 coin, the player cannot shoot for the Jackpot. If the projected coin misses and lands on a blank square or a frozen property square, the coin is placed on the nearest Jackpot Lane square. If the projected coin goes through any opponent's open holes, that opponent keeps the coin. If the coin goes through the player's own open hole, the money goes to Jackpot Lane. On the player's next turn, the player rolls the die and moves on Jackpot Lane. If there are any coins on Jackpot Lane square sockets upon which the player lands, the player collects those coins.

Player's are eliminated when they run out of coins. The last player with coins wins.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Reference to the drawings may be made easier by understanding the convention that the hundreds digit(s) of the reference number is the figure number in which the referenced item first appears.

Figure 1:
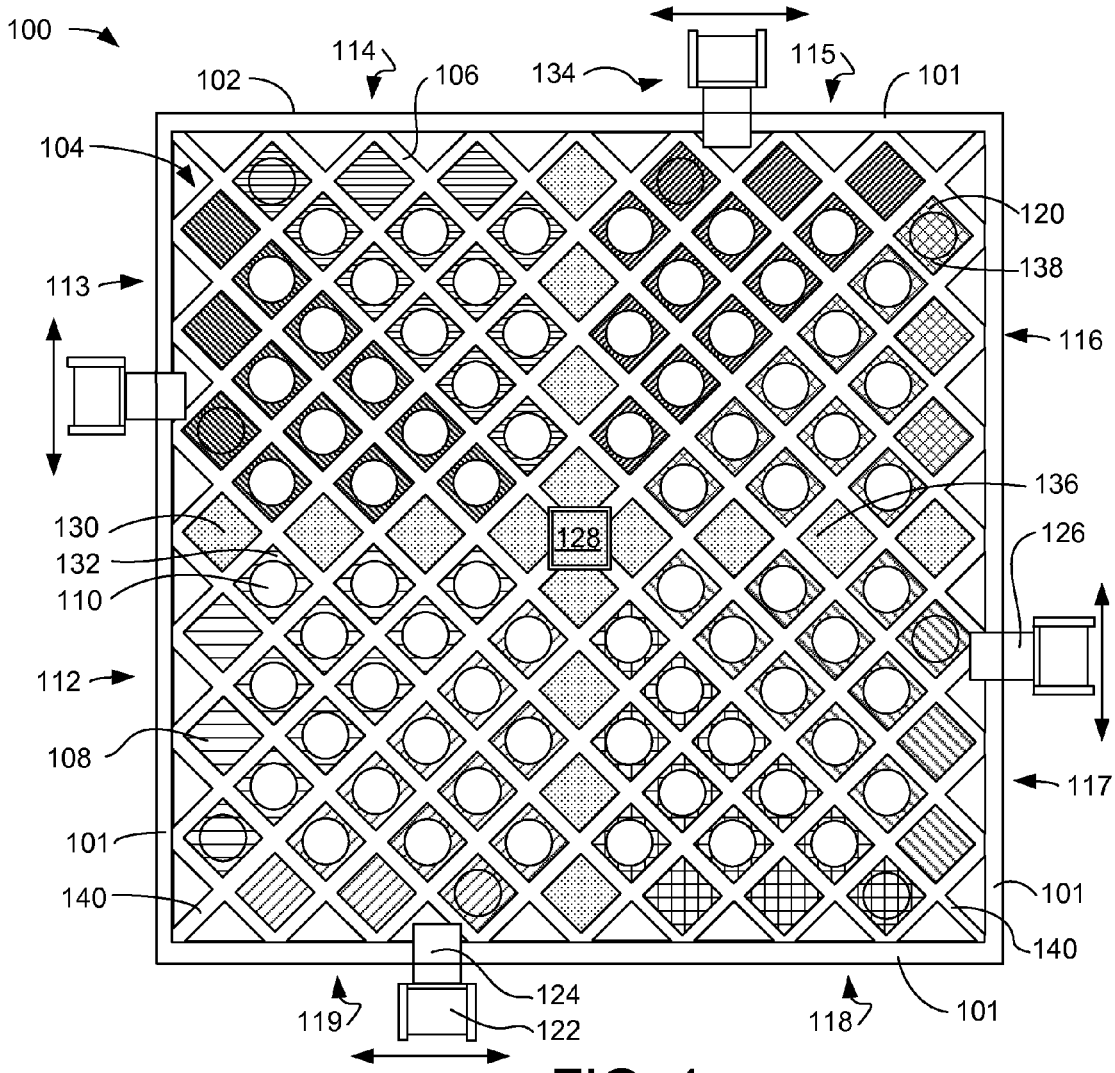
FIG. 1 is a top plan view illustrating an exemplary embodiment of a game board, according to a preferred embodiment of the present invention.

FIG. 1 is a top plan view illustrating an exemplary embodiment of a game board 100, according to a preferred embodiment of the present invention. FIG. 1 is not drawn strictly to scale. Square game board 100 has an enclosure 102 of four walls 101 upon each of which, one projectile projector 134, exemplified as a catapult 134 (one of four labeled) is mounted to slide along each wall 101, as illustrated by the double arrows. The game board 100 is shown in this view with no playing parts 400 (see FIG. 4) on the game board surface 104. The game board surface 104 is demarcated into forty-nine square sockets 108 (one of sixteen property name square sockets labeled), 120 (one of eight starting square sockets labeled), 130 (one of four Jackpot Lane entry square sockets labeled), and 132 (one of seventy-two hole square sockets labeled), by ridges 106. Ridges 106 may be formed as a one-piece lattice or by attaching lengths of ridge 106 material to the game board surface 104. The ridges 106 form sockets 108, 120, 130, and 132 for covers 402 (see FIG. 4) and playing tokens 410 (see FIG. 4). Triangular spaces adjacent the enclosure 102 are not used in the present embodiment of the game.

Figure 3:
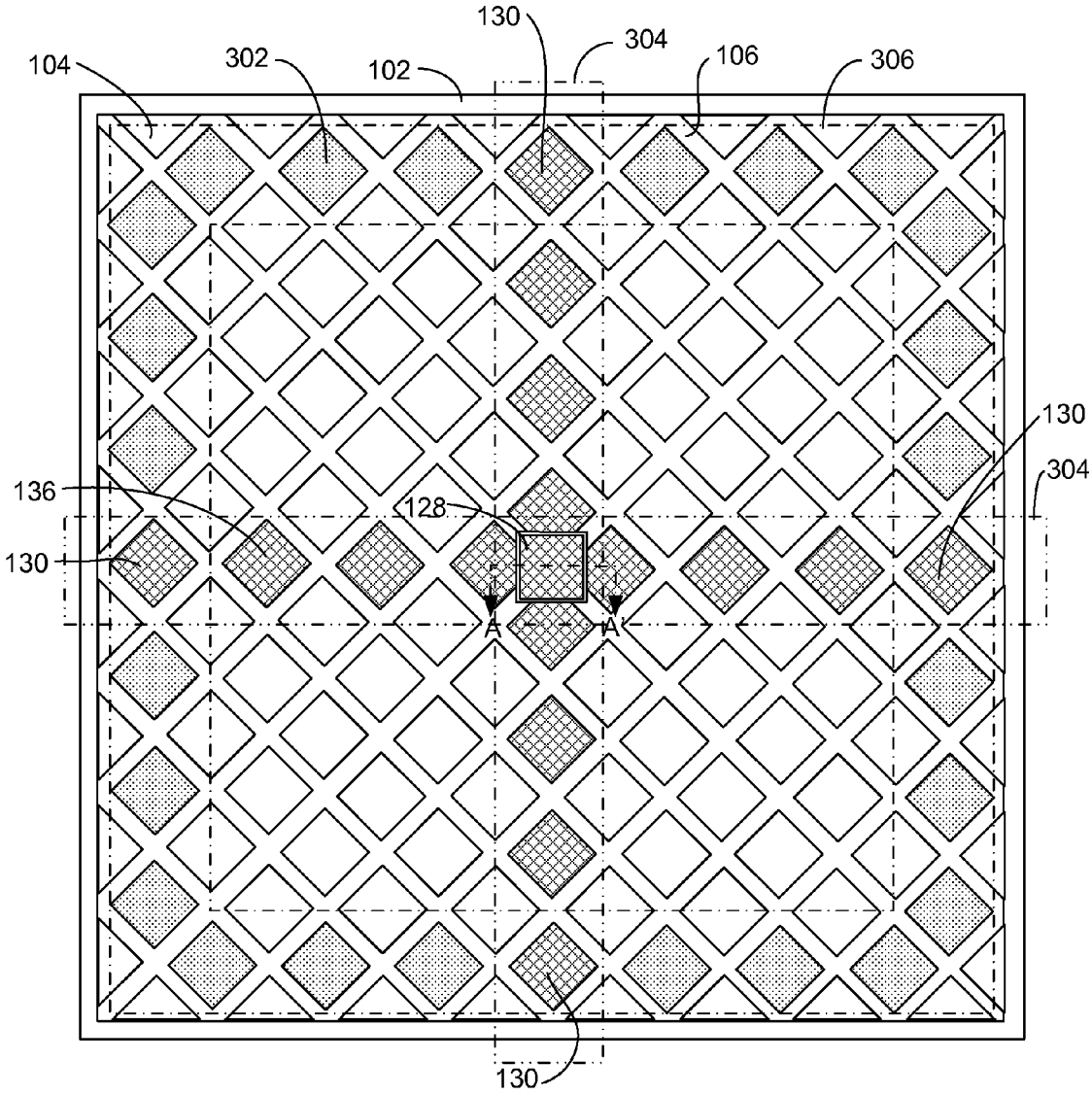
FIG. 3 is a top plan view illustrating exemplary movement paths on the exemplary game board of FIG. 1, and defining cross section A-A, according to a preferred embodiment of the present invention.
Figure 4:
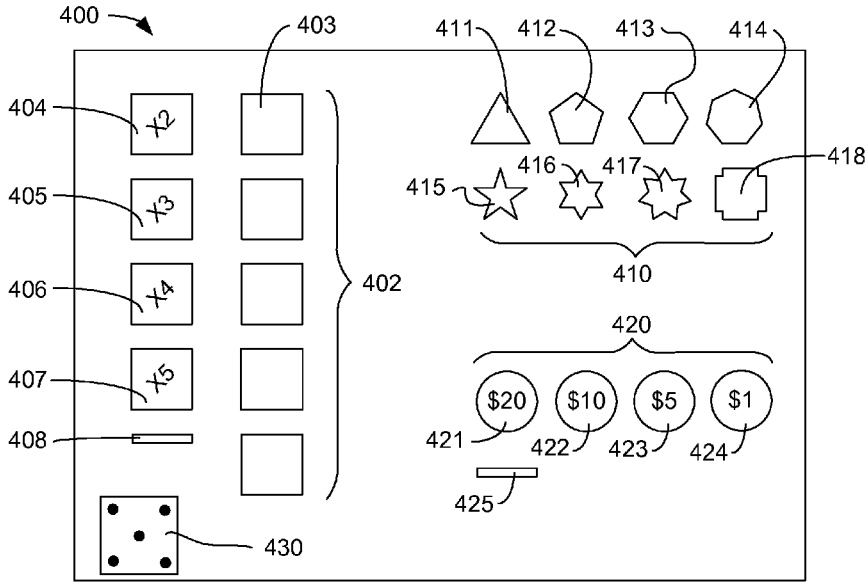
FIG. 4 is a diagrammatic view illustrating an exemplary set of playing parts for the exemplary game board of FIG. 1, according to a preferred embodiment of the present invention.

Twenty-eight square sockets 108 (one of sixteen property name square sockets labeled), 120 (one of eight starting square sockets labeled), and 130 (one of four Jackpot Lane entry square sockets labeled) around the perimeter of the playing surface 104 define a perimeter track 306 (see FIG. 3) for movement of playing tokens 410 (see FIG. 4). Starting square sockets 120 have an identifying mark 138, illustrated as a circle. Transverse to the walls 101 of the enclosure 102 are twelve square sockets 136 (one of twelve Jackpot Lane square sockets labeled) and 130 (one of four Jackpot Lane entry square sockets labeled) in two orthogonal rows for movement of playing tokens 410. Entry to Jackpot Lane 304 (see FIG. 3) is via landing on the middle square 130 (one of four Jackpot Lane entry square sockets labeled) of the perimeter track 306 (see FIG. 3) on any side of the perimeter track 306. A fiftieth square, the Jackpot square 128, is raised on a pedestal 1002 (see FIG. 10) in the center of game board 100. In a particular embodiment, more than one socket may be supported above the game board surface 104.

Jackpot Lanes 304 (see FIG. 3) divide the board into fourths, and each fourth is divided by a radial diagonal ridge 140 (two of four labeled) into two player properties 113 and 114, 115 and 116, 117 and 118, and 119 and 112 of twelve square sockets 120 (one starting square), 108 (two of property perimeter track square sockets) and 132 (nine hole square sockets), each. Accordingly, there are eight player properties 112, 113, 114, 115, 116, 117, 118, and 119, or playing positions, on the game board surface 104. The right-most square 120 (one of eight starting square sockets labeled) of the three property perimeter track square sockets 120, 108 (two of these) is designated as a starting point 120 for a playing piece 410 (see FIG. 4) of that property's player. The other nine square sockets 132 of the player property have holes 110 in them, and each player has nine covers 402 (see FIG. 4) for covering those holes 110. The covers 402 fit within the shallow socket defined by the ridges 106.

The catapults 134 (one of four labeled) each have a support portion 124, a spring portion 126, and a projectile-receiving portion 122. In a particular embodiment, catapults 134 may be made of separate pieces attached together. In various additional embodiments, various projectile-hurling devices 134, or projectile projectors 134, may be used.

Figure 2:
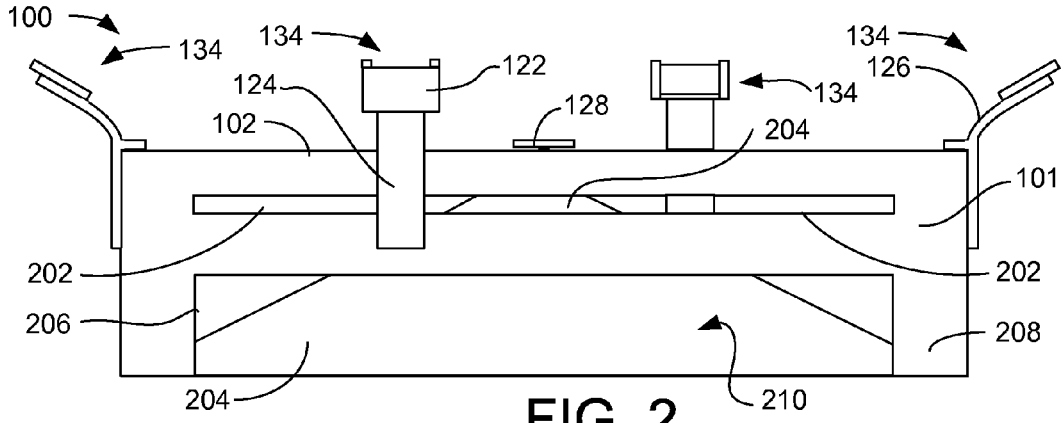
FIG. 2 is a side elevation view illustrating an exemplary embodiment of the game board of FIG. 1, according to a preferred embodiment of the present invention.

FIG. 2 is a side elevation view illustrating an exemplary embodiment of the game board 100 of FIG. 1, according to a preferred embodiment of the present invention. Each enclosure wall 101 has a horizontal rectangular opening 206 at the bottom that does not extend for the length of the enclosure wall 101, thereby forming legs 208 at each corner. The height of enclosure wall 101 should be sufficient to accommodate pyramidal deflector walls 204 (one of four visible in this view) that are steep enough to easily slide, or otherwise deflect, projectile coins 420, or projectile tokens 420, (see FIG. 4) out of horizontal rectangular opening 206. Each enclosure wall 101 has a horizontal slot 202 between horizontal opening 206 and the top of wall 101. The slot 202 receives a leg 1104 (see FIG. 11) of catapult 134 support portion 124 to stabilize the catapult 134. Enclosure wall 101 is made of a resilient material to assist in installing the catapults 134. Pyramidal deflector wall 204 receives projectile coins 420 (see FIG. 4) that fall through holes 110 and slide them on pyramid wall surface 210 through enclosure wall opening 206 and, preferably, outside enclosure wall 101. The rectangular shape of opening 206 is not a limitation of the present invention. A portion of pyramid deflector wall 204 can be seen through slot 202, as shown. Slot 202 is exemplified as being the same length as the rectangular opening 206, but the present invention is not so limited. In particular embodiments, pyramid deflector wall 204 may be part of a truncated pyramid having a base that fits within the enclosure wall 101 and a truncated top 1006 (see FIG. 10) that is small enough to avoid interference with projectile coins 420 (see FIG. 4) falling through holes 110 near the center of the game board 100. In an additional embodiment, pyramidal deflector walls 204 need not be flat and may number more or less than four.

FIG. 3 is a top plan view illustrating exemplary movement paths 304 and 306 on the exemplary game board 100 of FIG. 1, and defining cross section A-A, according to a preferred embodiment of the present invention. Perimeter track 306 is the primary path around which the player's piece 410 (see FIG. 4) moves in accordance with a die roll. Jackpot Lanes 304 are alternate paths by which the player's piece 410 (see FIG. 4) moves in accordance with a die roll, if the player's piece 410 first lands on a Jackpot Lane starting square 130 when moving on the perimeter track 306. Jackpot Lanes 304 run transverse to the enclosure walls 101 and cross in the middle of the playing board surface 104. Jackpot Lane 304 entry square sockets 130 are counted for movement around the perimeter track 306 but change the direction of movement if landed on at the end of a move. A player whose playing piece 410 lands on a Jackpot Lane entry square 130 will move across the board along Jackpot Lane 304 on that player's next turn. As will be seen in a discussion of the rules, below, there are advantages to landing on a Jackpot Lane entry square 130.

FIG. 4 is a diagrammatic view illustrating an exemplary set of playing parts 400 for the exemplary game board 100 of FIG. 1, according to a preferred embodiment of the present invention. Playing parts 400 include eight playing pieces 410, or player tokens 410, include tokens 411, 412, 413, 414, 415, 416, 417, and 418. In various embodiments, playing tokens 410 may be of various design and materials consistent with fitting in the square sockets 108, 120, and 130 of the game board surface 104 and consistently maintaining a shape. Covers 402 include four multiplier covers 404, 405, 406, and 407, marked as "X2", "X3", "X4", and "X5", respectively. Covers 402 also includes five blank covers 403 (one of five labeled). Cover 408 is shown in side elevation and is a side illustration of any of covers 403-407. Covers 402 are preferably cardboard, plastic, or similar lightweight, fairly rigid, material. Projectile coins 420 include projectile coins 421, 422, 423, and 424, marked as "$20", $10", "$5", and "$1", respectively. Projectile coin 425 is a side elevation view of a projectile coin and is a side illustration of any of projectile coins 421-424. Projectile coins 420 are preferably cardboard, plastic, or similar lightweight, fairly rigid, material. The diameter of projectile coins 420 is less than the diameter of holes 110. The exemplary projectile coins 420 are illustrated as all being the same size, but the present invention is not so limited. In an alternate embodiment, the projectile coins 420 may be different sizes for different values. Playing die 430, preferably a six-sided die, is rolled to determine movement of playing tokens 410 around the perimeter track 306 and along Jackpot Lane 304. In various additional embodiments, projectile coins 420 may be of various shapes and may not appear to be coins as much as tokens. For example, spherical tokens could be used.

Figure 5:
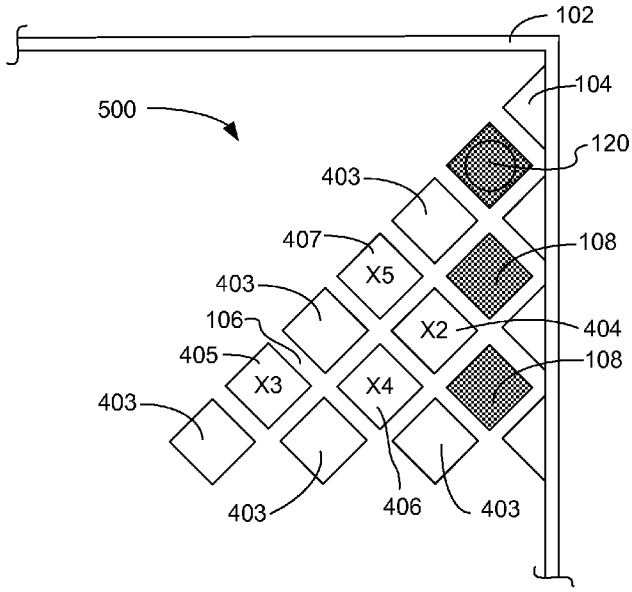
FIG. 5 is a top plan view illustrating exemplary square sockets of the exemplary game board of FIG. 1 configured as a "frozen" property , according to a preferred embodiment of the present invention.

FIG. 5 is a top plan view illustrating exemplary square sockets 108 and 120 and covers 403-407 of the exemplary game board 100 of FIG. 1 configured as a "frozen" property 500, according to a preferred embodiment of the present invention. A "frozen property" 500 is one that has no player associated with it in a particular playing of the game, and so all holes 110 are covered with covers 403-407. Frozen properties 500 occur when there are an odd number of players. The perimeter track square sockets 120 and 108 are neutral square sockets when part of a frozen property. There is no opportunity to score when landing on neutral square sockets. There are circumstances were an active player may have the configuration of FIG. 5, as when an opposing player lands on square 120, that opposing player has an option to either cover one of his opponent's square sockets or uncover one of his own. Two such events could convert a starting configuration 700 (see FIG. 7) to the configuration of FIG. 5.

Figure 6:
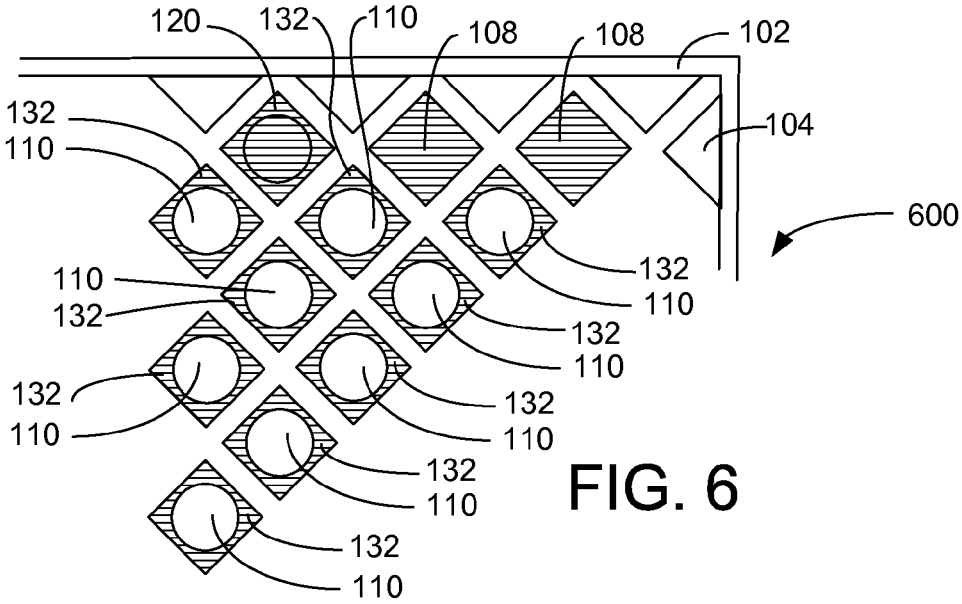
FIG. 6 is a top plan view illustrating exemplary square sockets of an exemplary player property on the exemplary game board of FIG. 1 without hole covers, according to a preferred embodiment of the present invention.

FIG. 6 is a top plan view illustrating exemplary square sockets 120, 108, and 132 of an exemplary player property 600 on the exemplary game board 100 of FIG. 1 without hole covers 402, according to a preferred embodiment of the present invention. Player property 600 is a pre-game configuration. No covers 402 have been placed and no playing tokens 410 have been placed on the game board surface 104.

Figure 7:
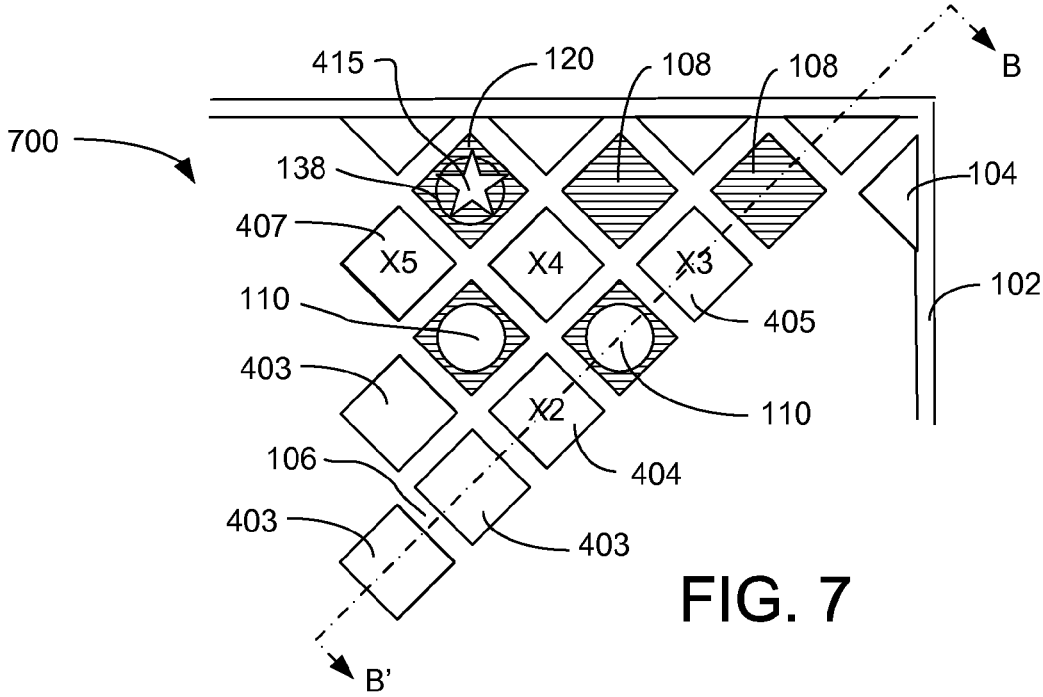
FIG. 7 is a top plan view illustrating exemplary square sockets of an exemplary player property on the exemplary game board of FIG. 1 configured to start play, and defining cross section B-B', according to a preferred embodiment of the present invention.

FIG. 7 is a top plan view illustrating exemplary square sockets of an exemplary player property 700 on the exemplary game board of FIG. 1 configured to start play, and defining cross section B-B', according to a preferred embodiment of the present invention. In preparing to play the game, each player places his four multiplier covers 404-407 and three of his blank covers 403 on square sockets 132 of his property 700 (as one of properties 112-119). In some games, such as a four-player game, each player may have more than one property 112-119. A player piece 415 is shown on starting square 120. Each other active property 112-119 will have a similar configuration of two holes 110 uncovered at the start of the game. The arrangement of multiplier covers 404-407 cannot be changed during a game.

Figure 8:
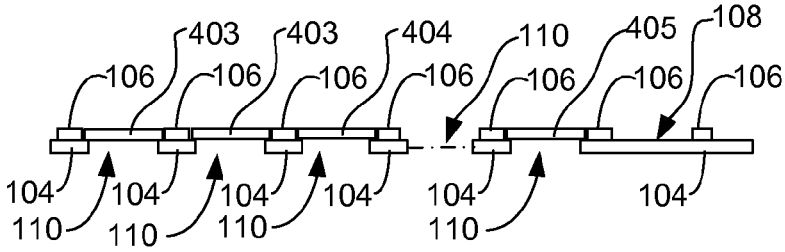
FIG. 8 is a side elevation view through cross section B-B' illustrating exemplary covers, holes, and ridges of the exemplary game board of FIG. 1, according to a preferred embodiment of the present invention.

FIG. 8 is a side elevation view through cross section B-B' illustrating exemplary covers 403, 404, 405, holes 110, and ridges 106 of the exemplary game board 100 of FIG. 1, according to a preferred embodiment of the present invention. The thickness of the covers 403-405 is preferably equal to the height of the ridges 106 to provide a smooth surface on which projected projectile coins 420 can slide after landing. The fit of the covers 403-405 within the ridges 106 is not too tight, so as to assist manual removal. In a particular embodiment, the height of the covers 403-405 may be slightly greater than the height of the ridges 106.

In setting up the game, all active properties are set up as in property 700, but with individual variation in placement of particular covers 402. In addition to nine covers 402 and a playing piece 411-418, each player receives a plurality of projectile coins 420, denominated $20, $10, $5, and $1. Each player receives three $20, three $10, five $5, and five $1 projectile coins 420 before the game starts.

Figure 9:
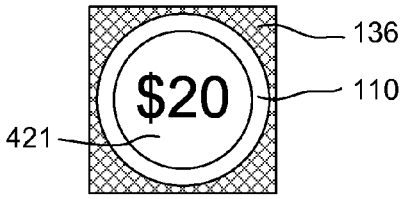
FIG. 9 is a top plan view of an exemplary square having a hole with an exemplary projectile coin therein, according to a preferred embodiment of the present invention.

FIG. 9 is a top plan view of an exemplary square 136 having a hole 110 with an exemplary projectile coin 421 therein, according to a preferred embodiment of the present invention. The diameter of the projectile coin 421 is less than the diameter of the hole 110. Projectile coins may be of various sizes, optionally correlated to the represented value on the face of the coin. In a particular embodiment, the projectile coins 420 may have various shapes.

Figure 10:
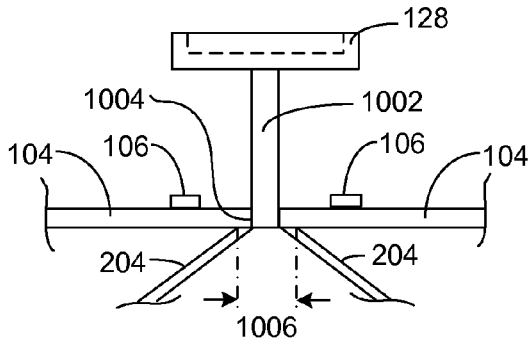
FIG. 10 is a side elevation view through cross section A-A' illustrating an exemplary pedestal square of the exemplary game board of FIG. 1, according to a preferred embodiment of the present invention.

FIG. 10 is a side elevation view through cross section A-A' illustrating an exemplary pedestal square 128 of the exemplary game board of FIG. 1, according to a preferred embodiment of the present invention. Pedestal 1002 is inserted in a bore 1004 through the game board surface 104 to support pedestal square 128. The bore 1004 is in the center of the game board surface 104, just above the top of the pyramidal deflector walls 204, shown here as a truncated pyramid having a width 1006 that is small enough to allow projectile coins 420 to fall through holes 110 that are near the center of game board 100.

Figure 11:
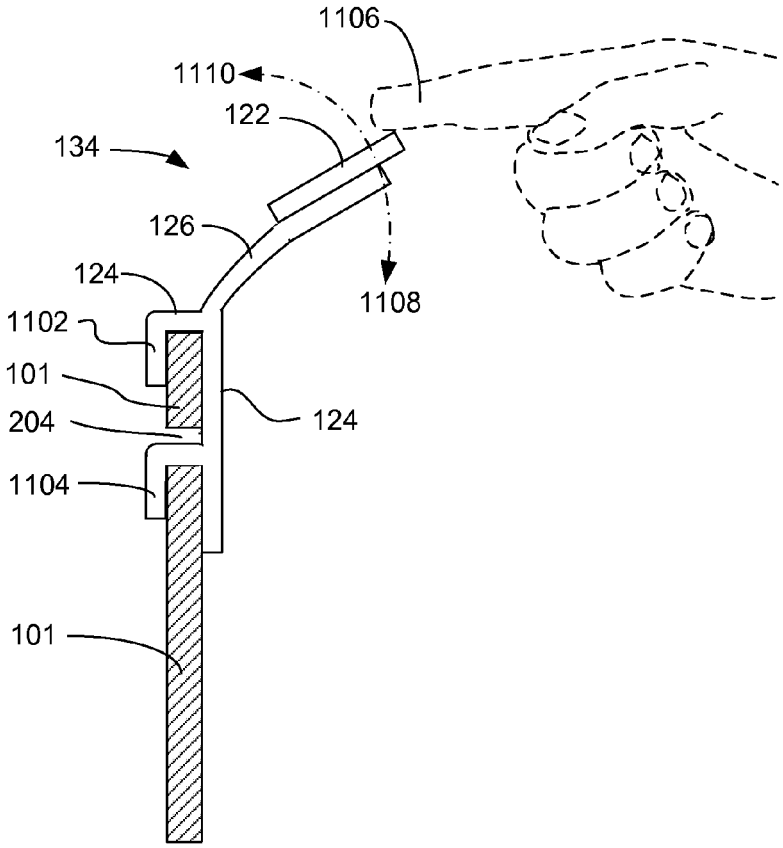
FIG. 11 is a side elevation view illustrating an exemplary catapult on an exemplary enclosure wall of the exemplary game board of FIG. 1, according to a preferred embodiment of the present invention.

FIG. 11 is a side elevation view illustrating an exemplary catapult 134 on an exemplary enclosure wall 101 of the exemplary game board 100 of FIG. 1, according to a preferred embodiment of the present invention. Catapult 134 includes a support portion 124, a reed spring portion 126 extending from the support portion 124, and a projectile receiver 122 coupled to reed spring portion 126. Catapult 134 support portion 124 has a top leg 1102 that extends over the top of enclosure wall 101 and downward against the interior surface of wall 101, as shown, and a bottom leg 1104 that extends over the bottom edge of slot 202 and downward against the interior surface of enclosure wall 101. In operation, projectile receiver 122 receives a projectile coin and is deflected downward 1108 against the bias of reed spring portion 126 by a player's finger 1106. At a point determined by practice and experience, the user lets go of the catapult 134 and the reed spring portion 126 propels the projectile coin upward and forward 1110. Projectile receiver 122 has a bottom lip and two side ridges to assist in holding the projectile coin 420.

Figure 12:
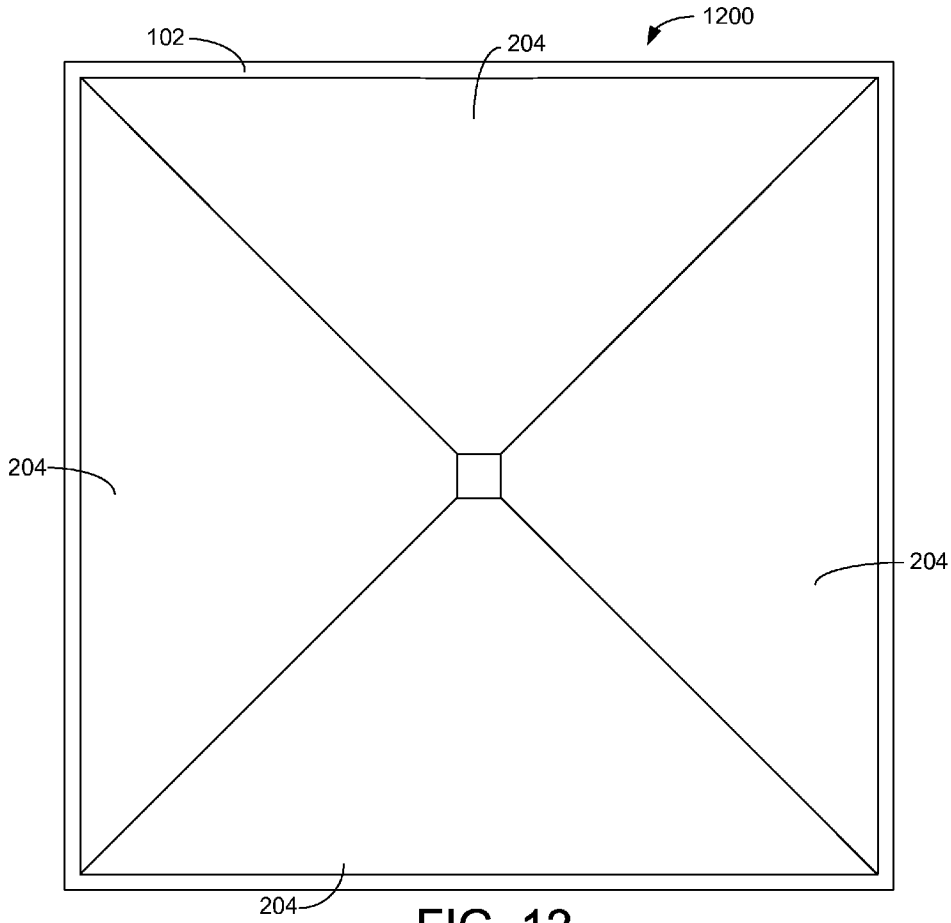
FIG. 12 is a top plan view illustrating an exemplary coin-sliding pyramid underlying the exemplary game board of FIG. 1, according to a preferred embodiment of the present invention.

FIG. 12 is a top plan view illustrating an exemplary coin-sliding pyramid 1200 underlying the exemplary game board surface 104 of FIG. 1, according to a preferred embodiment of the present invention. Four truncated pyramidal deflector walls 204 form the coin-sliding truncated pyramid 1200. In typical operation, the projectile coin 420 that falls through a hole 110 will be slid or deflected toward the player who is entitled to keep it by pyramid walls 204. In a particular embodiment, the pyramid 1200 may not be truncated. In an additional embodiment, the pyramidal deflector walls 204 may not be flat.

Figure 13:
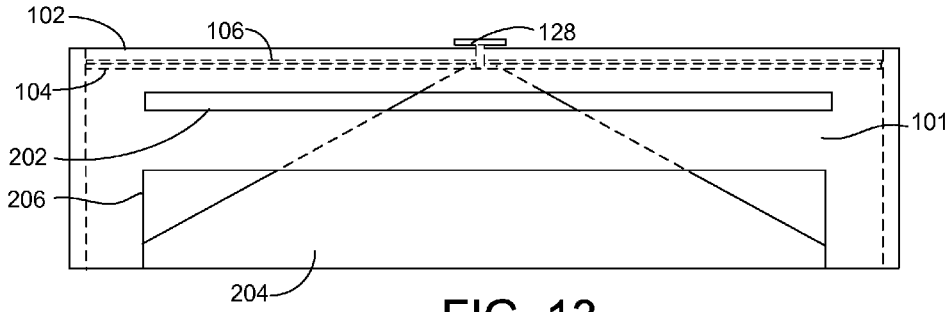
FIG. 13 is a side elevation x-ray view of illustrating a wall of the exemplary game board of FIG. 1, according to a preferred embodiment of the present invention.

FIG. 13 is a side elevation x-ray view of illustrating a wall 101 of the exemplary game board 100 of FIG. 1, according to a preferred embodiment of the present invention. The relationship of the game board surface 104, ridges 106, and coin-deflecting pyramidal deflector walls 204 can be seen. In an additional embodiment, the pyramidal deflector walls 204 are not flat.

Figure 14:
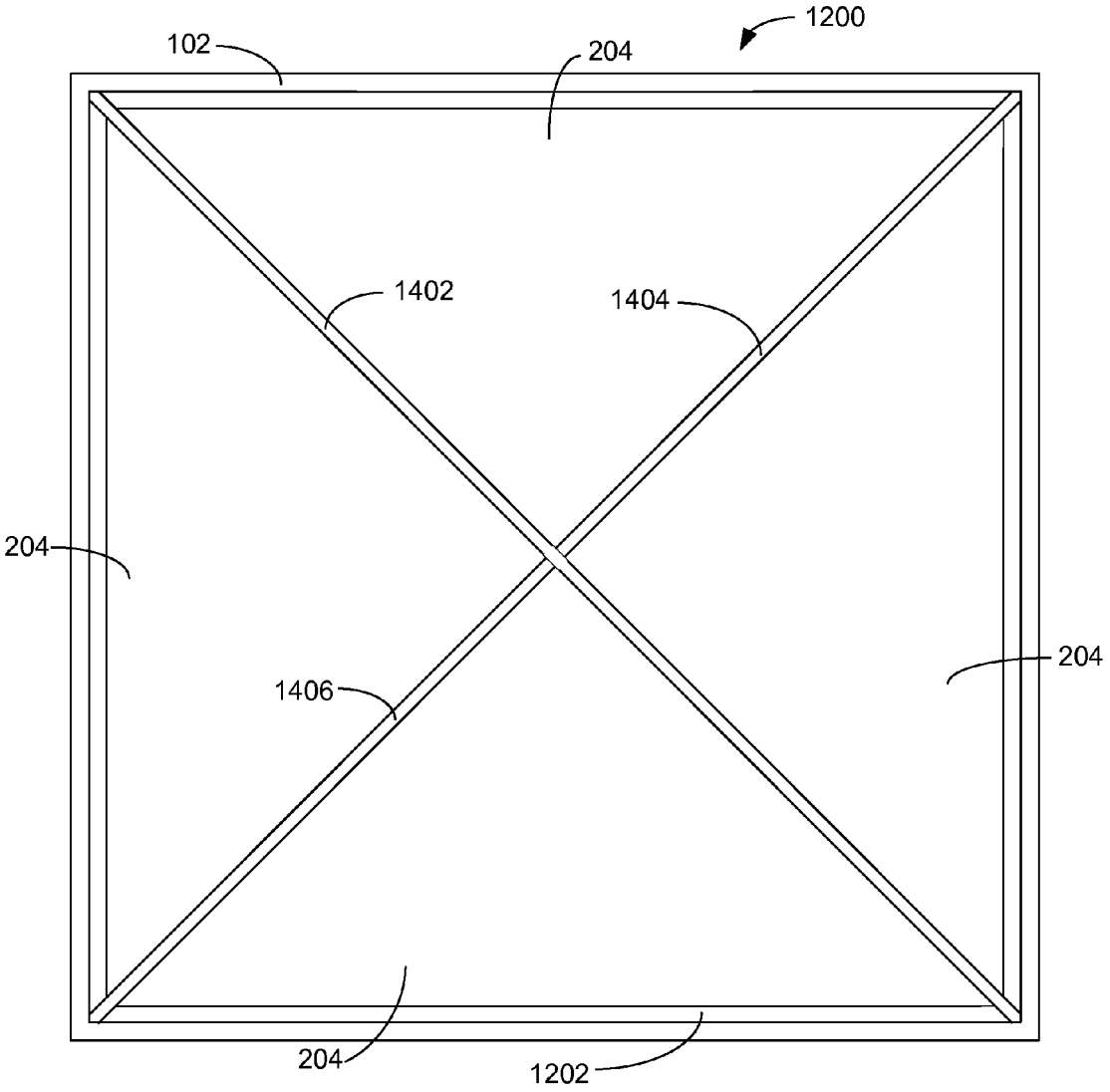
FIG. 14 is a bottom plan view illustrating an exemplary coin-sliding pyramid underlying the exemplary game board of FIG. 1, according to a preferred embodiment of the present invention.

FIG. 14 is a bottom plan view illustrating an exemplary coin-sliding pyramid 1200 underlying the exemplary game board 100 of FIG. 1, according to a preferred embodiment of the present invention. Cross support 1402 is a fin and is preferably truncated triangular or, less preferably, triangular. Cross support 1402 extends between two interior bottom corners of the enclosure 102 and has a bottom edge (as shown) that is level with the bottom of enclosure 102. The upper edges of cross support 1402 support side edges of pyramid walls 204. Truncated triangular side supports 1404 and 1406 are fins that also have lower edges (as shown) that are level with the bottom of enclosure 102. Side supports 1404 and 1406 have top edges that extend to support side edges of pyramid walls 204. Side supports 1404 and 1406 each has a third edge that is fixedly abutted and coupled to cross support 1402. The bottom edges 1202 of pyramid walls 204 are visible in this view. Cross support 1402 and side supports 1404 and 1406 are exemplary. In various additional embodiments, various methods of supporting pyramid 1200 may be used.

Figure 15:
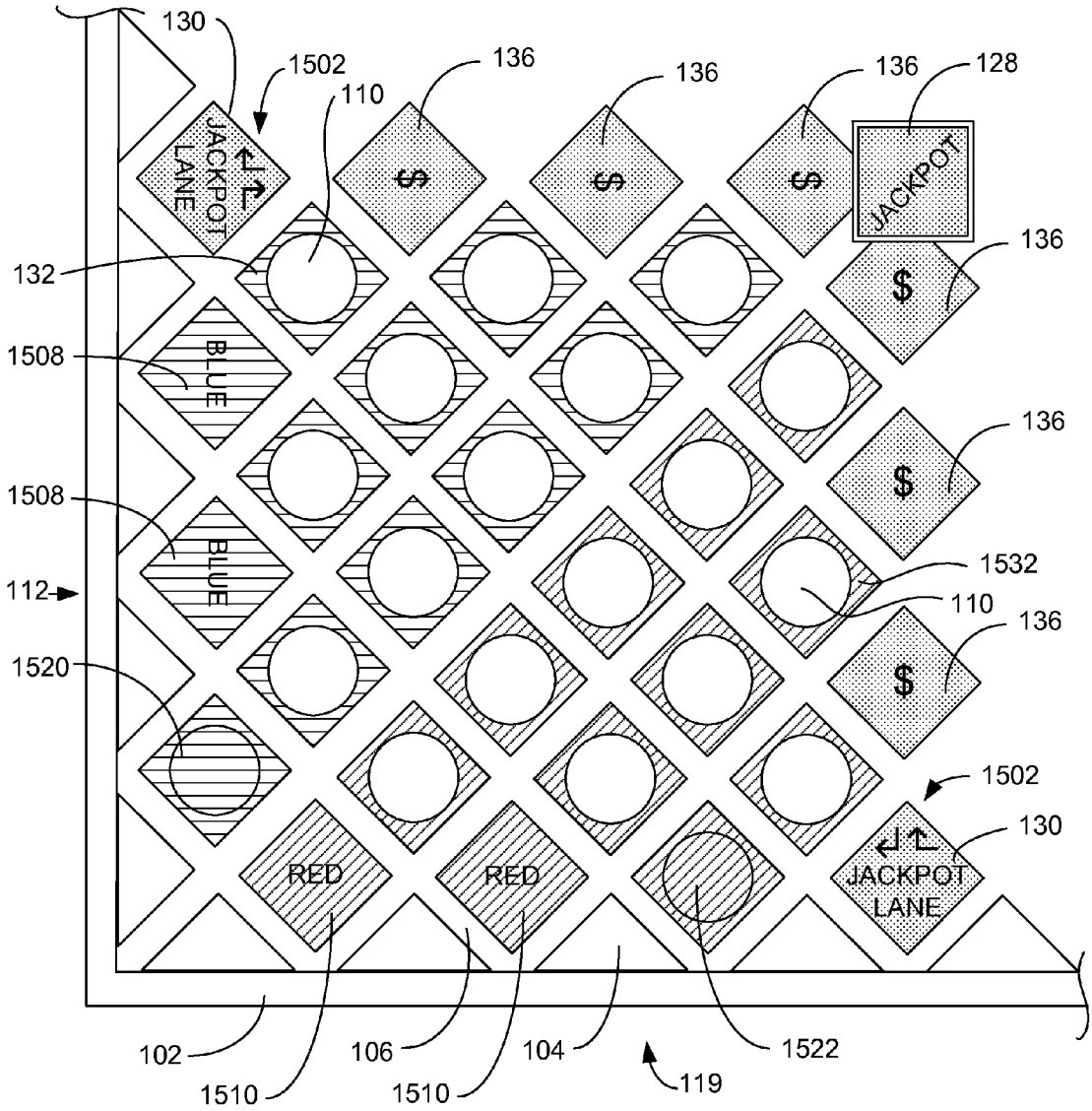
FIG. 15 is a top plan view illustrating an exemplary fourth of the exemplary game board of FIG. 1, according to a preferred embodiment of the present invention.

FIG. 15 is a top plan view illustrating an exemplary fourth of the exemplary game board 100 of FIG. 1, according to a preferred embodiment of the present invention. FIG. 15 illustrates game board markings in a preferred embodiment of the present invention. Jackpot Lane entry square sockets 130 are shown marked "Jackpot Lane" with directional arrows 1502 indicating movement into and out of Jackpot Lane. Jackpot Lane square sockets 136 are shown with dollar markings. Pedestal square 128 is preferably marked as "JACKPOT". The property name square sockets 1508 and 1510, (similar to property name square sockets 108 in FIG. 1) bear names uniquely identifying the properties 112, 119. In various alternate embodiments, various naming schemes can be used. For example, names based on actual real estate, places from science fiction or fantasy fiction, or entirely made up names, may be used. Preferably, all square sockets of a particular property 112-119 have the same color or shading. In a particular embodiment, covers 403-407 have colors corresponding to a property 112-119. In another preferred embodiment, the perimeter track 306 square sockets 1508, 1510, 1520 and 1522 (and 108 in FIG. 1 (one of sixteen property name square sockets labeled) and 120 in FIG. 1 (one of eight starting square sockets labeled)) have a common color, except for the Jackpot Lane entry square sockets 130 (one of four labeled in FIG. 1).

Referring now to FIGS. 1-15, the play of the game is described. In setting up to begin the game, each player covers seven of the nine holes on his property using the four multiplier covers 404-407 and three of the blank covers 403. The player may arrange the covers 402 on his property in any pattern he desires. Strategically, it is preferred to place the high multiplier covers 404-407 near the open uncovered holes 110, to increase the risk to a player who is trying to project a projectile coin 420 onto a high multiplier cover 404-407.

For some numbers of players, each player may have more than one property 112-119. For example, in a four-player game, each player may have two properties 112-119. For further example, in a three-player game, each player may have two properties 112-119 with the remaining two properties 112-119 considered "frozen" properties 500. Landing on a perimeter track square 108 or 120 of a frozen property 500 is treated as a free space, with no consequences. If a projected coin 420 lands on a frozen property 500, it is placed in Jackpot Lane 304 on the nearest Jackpot Lane square 136. Frozen properties 500 have all nine holes 110 covered.

To play, a die 430 is cast to determine who starts, and that player again casts a single die 430, preferably a six-sided die 430. The player moves his playing piece 410 from his property's starting square 120 a number of spaces equal to the number indicated on the rolled die 430. Depending on the square landed upon, different consequences result.

If a player lands on a frozen property 500 square, there are no consequences and the next player, going clockwise, takes his turn.

If a player lands on an opponent's perimeter track square that is one of the two perimeter track square sockets 108 that are not a starting square 120, then the player gets to launch a projectile coin 420 at that opponent's property 112-119 in an attempt to get more projectile coins 420. The projecting player uses the catapult 134 (one of four labeled in FIG. 1) on the enclosure wall 101 of the game board 100 adjacent to his own property 112-119. Different results are determined based on where the projectile coin 420 lands. If the projectile coin 420 lands on a multiplier covered 404-407 square 132 (one of seventy two labeled in FIG. 1) on the opponent's property 112-119, the opponent must pay the player an amount equal to the value of the coin 420 projected times the multiplier on the cover 404-407. If the coin 420 lands on a blank covered 403 square 132, or misses the opponent's property 112-119 entirely, the coin 420 is placed on the nearest Jackpot Lane square 130-136 to the square upon which the coin 420 landed, and the projecting player gets nothing. If the coin 420 goes through a hole 110 on the opponent's property, the opponent keeps the coin. If the projectile coin 420 falls through a hole 110, it slides or bounces down an inclined plane pyramid deflector wall 204 and out of an opening 206 in the enclosure wall 101 below the level of the game surface 104. There are four triangular inclined plane pyramid walls 204 below the game surface 104 forming a pyramid 1200, for sliding or deflecting fall-through coins 420 through each of the four walls 101 via openings 206.

If the player's playing piece 410 lands on an opponent's starting square 120, the player may either cover one of the opponent's holes 110 with one of the opponent's unused covers 402 or remove one of the blank covers 403 on the player's own property 112-119, at the player's option.

If the player lands on one of the four Jackpot Lane entry square sockets 130 on the perimeter track 306, the player first gets to shoot for the Jackpot. If the player can project a $10 coin 422 into the Jackpot square 128 on the pedestal 1002 in the middle of the game board surface 104, that player wins all the coins 420 in all square sockets 136 in Jackpot Lane 304. If the player does not have a $10 coin 422, the player cannot shoot for the Jackpot. If the projected coin 422 misses and lands on a blank square 403 or a frozen property 500 square, the coin 422 is placed on the nearest Jackpot Lane square 136. If the projected coin 422 goes through any opponent's open holes 110, that opponent keeps the coin 422. If the coin 422 goes through the player's own open hole 110, the coin 422 goes to Jackpot Lane 304. Regardless of the outcome of shooting at the Jackpot, on the player's next turn, the player rolls the die 430 and moves on Jackpot Lane 304 according to the die roll result. If there are any coins 420 on Jackpot Lane square sockets 136 upon which the player lands, the player collects those coins 420.

Player's are eliminated when they run out of coins 420. The last player with coins 420 wins.

Although applicant has described applicant's preferred embodiments of this invention, it will be understood that the broadest scope of this invention includes such modifications as diverse shapes and sizes and materials. Such scope is limited only by the above specification and the claims below. While applicant has described one exemplary game that may be played with game board 100, other games that may be played with the game board 100 are within the scope of the invention.

Further, many other advantages of applicant's invention will be apparent to those skilled in the art from the above descriptions.

We claim:

1. A board game comprising:

a. a game board having an array comprising:

i. a first plurality of sockets on a top surface of said game board; and ii. a second plurality of sockets within said first plurality of sockets, said second plurality of sockets comprises a corresponding second plurality of holes through said game board;

b. wherein said game board is oriented horizontally when in use; and c. an enclosure comprising at least one enclosure wall, wherein said enclosure surrounds and at least partially supports said game board and said at least one enclosure wall extends above and below said game board.

2. The board game of claim 1, comprising a pedestal in a middle of said game board, wherein said pedestal supports an elevated socket.

3. The board game of claim 1, comprising a deflection structure underneath and supporting said game board, wherein said deflection structure is operable to deflect an object that falls through a hole of said second plurality of holes.

4. The board game of claim 1, comprising at least one elongated opening along a bottom portion of said at least one enclosure wall, wherein said at least one elongated opening is not as long as said at least one enclosure wall.

5. The board game of claim 1, comprising at least one elongated slot in said at least one enclosure wall parallel to and spaced apart from a top edge of said at least one enclosure wall, wherein said at least one elongated slot is not as long as said at least one enclosure wall.

6. The board game of claim 5, comprising at least one projectile projector slidingly mounted on said top edge of said at least one enclosure wall and on a bottom edge of said at least one elongated slot.

7. The board game of claim 6, further comprising:

a. a plurality of variously denominated projectile tokens, each sized and shaped to fall through a hole of said second plurality of holes and operable to be projected by said at least one projectile projector;

b. a plurality of hole covers each sized and shaped to fit into a socket of said plurality of sockets;

c. a plurality of player tokens, each sized to fit into a socket of said plurality of sockets; and d. a playing die, operable to randomly generate a number indicating movement of a player token of said plurality of player tokens.

8. The board game of claim 7, wherein said plurality of hole covers comprises a smaller plurality of covers denominated with multipliers.

9. The board game of claim 7, wherein a sequence of sockets of said first plurality of sockets that are adjacent a perimeter of said game board and that are not of said second plurality of sockets comprise a primary path for movement of said plurality of player tokens.

10. The board game of claim 9, wherein at least two sequences of sockets of said first plurality of sockets which are not of said second plurality of sockets form at least one crossing path through a middle of said game board, and comprise at least one secondary path for movement of said plurality of player tokens.

11. The board game of claim 10, wherein said first plurality of sockets is divided into an equal number of groupings of contiguous sockets, each comprising at least three primary path sockets, no crossing path sockets, and at least six sockets each having a hole.

12. The board game of claim 6, further comprising:

a. a plurality of variously denominated projectile tokens, each sized and shaped to fall through said hole and operable to be projected by said at least one projectile projector;

b. a plurality of hole covers each sized and shaped to fit into a socket of said plurality of sockets, wherein said plurality of hole covers comprises a smaller plurality of covers denominated with multipliers;

c. a plurality of player tokens, each sized to fit into a socket of said plurality of sockets; and d. a playing die, operable to randomly generate a number indicating movement of a player token of said plurality of player tokens.

13. The board game of claim 12, wherein:

a. a sequence of sockets of said first plurality of sockets that are adjacent a perimeter of said game board comprise a primary path for movement of said plurality of player tokens; and b. at least two sequences of sockets of said first plurality of sockets that form crossing paths through a middle of said game board and comprise secondary paths for movement of said plurality of player tokens; and c. said first plurality of sockets is divided into an equal number of groupings of contiguous sockets, each comprising at least three primary path sockets, no crossing path sockets, and at least six sockets of said second plurality of sockets.

14. A board game comprising:

a. a game board having an array comprising:

i. a first plurality of sockets; and ii. a second plurality of sockets within said first plurality of sockets, said second plurality of sockets comprises a corresponding second plurality of holes through said game board;

b. wherein said game board is oriented horizontally when in use;

c. an enclosure comprising at least one enclosure wall, wherein said enclosure surrounds and at least partially supports said game board and said at least one enclosure wall extends above and below said game board; and d. at least one elevated socket supported above said game board.

15. The board game of claim 14, comprising:

a. at least one elongated opening along a bottom portion of said at least one enclosure wall, wherein said at least one elongated opening is not as long as said at least one enclosure wall; and b. at least one elongated slot in said at least one enclosure wall parallel to and spaced apart from a top edge of said at least one enclosure wall, wherein said at least one elongated slot is not as long as said at least one enclosure wall.

16. The board game of claim 15, comprising a deflection structure underneath and supporting said game board, wherein said deflection structure is operable to urge an object that falls through a hole of said second plurality of holes toward and through said elongated opening.

17. The board game of claim 15, at least one projectile projector slidingly mounted on said top edge of said at least one enclosure wall and on a bottom edge of said at least one elongated slot.

18. A board game comprising:

a. a game board having an array comprising:

i. a first plurality of sockets; and ii. a second plurality of sockets within said first plurality of sockets, said second plurality of sockets comprises a corresponding second plurality of holes through said game board;

b. wherein said game board is oriented horizontally when in use;

c. an enclosure comprising at least one enclosure wall, wherein said enclosure surrounds and at least partially supports said game board and said at least one enclosure wall extends above and below said game board; and d. an elevated socket supported above and in a middle of said game board;

e. at least one elongated opening along a bottom portion of said at least one enclosure wall, wherein said at least one elongated opening is not as long as said at least one enclosure wall;

f. at least one elongated slot in said at least one enclosure wall parallel to and spaced apart from a top edge of said at least one enclosure wall, wherein said at least one elongated slot is not as long as said at least one enclosure wall;

g. a deflection structure underneath and supporting said game board, wherein said deflection structure is operable to urge an object that falls through a hole of said second plurality of sockets toward and through said elongated opening;

h. wherein a sequence of sockets of said first plurality of sockets that are adjacent a perimeter of said game board comprise a primary path for movement of a plurality of player tokens;

i. wherein at least two sequences of sockets of said first plurality of sockets that form crossing paths through a middle of said game board comprise secondary paths for movement of said plurality of player tokens; and j. wherein said first plurality of sockets is divided into an equal number of groupings of contiguous and similarly demarcated sockets, each comprising at least three primary path sockets, no crossing path sockets, and at least six sockets of said second plurality of sockets.

19. The board game of claim 18, comprising:

a. at least one projectile projector slidingly mounted on said top edge of each enclosure wall of said at least one enclosure wall and on a bottom edge of each elongated slot of said at least one elongated slot;

b. a plurality of variously denominated projectile tokens, each sized and shaped to fall through said hole and operable to be projected by said at least one projectile projector;

c. a plurality of hole covers each sized and shaped to fit into a socket of said first plurality of sockets, wherein said plurality of hole covers comprises a smaller plurality of covers denominated with multipliers;

d. said plurality of player tokens, each sized to fit into a socket of said first plurality of sockets; and e. a playing die, operable to randomly generate a number to indicate movement of a player token of said plurality of player tokens.

20. The board game of claim 18, wherein:

a. said game board is square;

b. said at least one enclosure wall comprises four enclosure walls;

c. said first plurality of sockets comprises forty-nine square sockets in said array oriented forty five degrees to said square game board;

d. said deflection structure comprises a truncated pyramid shell with fin supports between opposed sloped edges and with a top base abutting an underside of said game board in said middle of said game board and a bottom base level with a bottom of said four enclosure walls;

e. said equal number of variously demarcated groupings of contiguous sockets comprises eight groupings each comprised of three said perimeter sockets, wherein one said perimeter socket is demarcated as a starting socket, and nine said sockets of said second plurality of sockets, arranged as one-half of a diagonally-divided corner of said square game board;

f. said secondary path sockets comprise twelve said sockets that are not part of said second plurality of sockets and are demarcated as said secondary path sockets;

g. said primary path sockets comprise twenty-eight said sockets, are not part of said second plurality of sockets, and are demarcated one of according to said grouping or as an entry socket to one of said secondary paths;

h. said at least one projectile projector comprises four projectile projectors wherein one said projectile projector is mountable on each said enclosure wall;

i. said plurality of variously denominated projectile tokens comprises, for each of eight players, three projectile coins denominated "$20", three projectile coins denominated "$10", five projectile coins denominated "$5", and five projectile coins denominated "$1" projectile coins; and j. said plurality of hole covers comprises, for each said grouping, one hole cover denominated "X5", one hole cover denominated "X4", one hole cover denominated "X3", one hole cover denominated "X2", and five hole covers without denomination.

* * * * *